US005927665A

United States Patent [19]

Grabnic

[11] Patent Number: 5,927,665

[45] Date of Patent: Jul. 27, 1999

[54] IMPLEMENT MOUNTING SYSTEM

[75] Inventor: Michael L. Grabnic, Walton Hills, Ohio

[73] Assignee: Allied Construction Products, Inc., Cleveland, Ohio

[21] Appl. No.: 09/110,099

[22] Filed: Jul. 2, 1998

[51] Int. Cl.[6] ..... A01B 51/00

[52] U.S. Cl. ..... 248/200; 172/272; 403/4; 414/723

[58] Field of Search ..... 248/200, 284.1, 248/635; 172/272, 273; 414/723; 403/3, 4, 154, 155, 365

[56] References Cited

U.S. PATENT DOCUMENTS

| | | | |
|---|---|---|---|
| 2,177,148 | 10/1939 | Newhall | 403/4 |
| 3,389,819 | 6/1968 | Schumacher | 414/723 X |
| 3,428,113 | 2/1969 | Kluth . | |
| 3,866,938 | 2/1975 | Boyd et al. . | |
| 4,056,250 | 11/1977 | Uchiyama | 172/272 X |
| 4,106,876 | 8/1978 | Tregoning . | |
| 4,117,890 | 10/1978 | Youngers | 403/4 X |
| 4,446,753 | 5/1984 | Nagano . | |
| 4,539,764 | 9/1985 | Pradier | 403/4 X |
| 4,825,777 | 5/1989 | Cummins . | |
| 4,836,741 | 6/1989 | St. Louis et al. . | |
| 4,944,628 | 7/1990 | Hulden | 172/272 X |
| 4,948,328 | 8/1990 | Busch | 172/273 X |
| 5,252,022 | 10/1993 | Culp et al. | 172/273 X |
| 5,387,047 | 2/1995 | Korpi . | |
| 5,449,243 | 9/1995 | Haab et al. . | |
| 5,632,567 | 5/1997 | Lowe et al. | 403/3 |

*Primary Examiner*—Derek J. Berger
*Attorney, Agent, or Firm*—Watts, Hoffmann, Fisher & Heinke Co.

[57] ABSTRACT

The mounting system for mounting the implement to a boom assembly forming part of a construction vehicle, such as an excavator, pedestal boom, and backhoe. A pair of spaced apart side plates include aligned apertures for receiving adapter plugs sized to be received within the apertures and for resisting relative rotation therebetween. Each adapter includes a transverse bore which is sized to receive a first pin member, such that each transverse bore is of an associated pair of adapter plugs defines the pin diameter that will be accepted, as well as partially defining the distance between a first pin member and a second pin member. Each adapter plug defines a flange portion having a surface abuttably engages a side surface of its associated side plate. The flange portions of an associated pair of adapter plugs define thrust surfaces for a boom member coupled to a pin carried by the adapter plugs. The thrust surface may be machinable to adjust the lateral spacing between an associated pair of adapter plugs. Keeper bolts extend through transverse bores formed in the adapter plugs which are alignable with the transverse bore associated near a distal end of the associated pin. The adaptors may be formed from cast components or fabricated using weldments.

14 Claims, 4 Drawing Sheets

IMPLEMENT MOUNTING SYSTEM

TECHNICAL FIELD

The present invention relates generally to construction equipment and, in particular, to a mounting system for attaching implements, such as a hammer, tamper, bucket, grapple, etc. to the boom of an excavator, backhoe, pedestal boom, etc.

BACKGROUND ART

Construction vehicles, such as excavators and backhoes, include a boom assembly to which various attachments are coupled. These attachments may include a bucket, hydraulic hammer, tamper, compactor, grapple, etc. The attachment typically includes a pair of parallel, spaced apart pins which are engaged by the end of the boom and an associated operating linkage. The manufacturer of the boom dictates the pin diameter and pin spacing that the boom is intended to work with. As a result, attachments made by independent manufacturers have required custom machining to provide the requisite pin diameter and pin spacing.

Recently, couplers have been developed which are intended to facilitate the attachment and detachment of an implement from the end of a boom. In order for the coupler to operate reliably, the pin diameter and pin spacing of an attachment must be relatively precise. In the past, attachments such as hammers, compactors and tampers have required custom machining to provide the precise pin spacing and pin diameter.

DISCLOSURE OF THE INVENTION

The present invention provides a new and improved mounting system by which implements or attachments, such as hammers, tampers, compactors, buckets, grapples, etc. can be coupled to a boom of a vehicle, such as an excavator, back hoe, pedestal boom, etc.

According to the invention, the mounting system includes a mounting member having a pair of spaced apart, upstanding, preferably parallel, side plates. Each side plate includes at least one aperture aligned with a companion aperture formed on the other side plate. Adapter plugs are sized to be received within each side plate aperture; each adapter plug includes structure for resisting relative rotation between itself and its associated side plate. Each adapter plug includes a transverse bore which is sized to receive a replaceable pin member. The aligned bores of associated adapter plugs at least partially define the relative spacing between a pin received in the bores and another pin carried by the mounting member.

According to a feature of the invention, each adapter plug includes a flange portion including a surface that abuttably engages a side surface of its associated side plate.

Each adapter plug preferably includes a pair of aligned bores that extend into its associated pin bore and are adapted to receive a keeper bolt which extends through a transverse bore in a distal end of a pin carried within the bore of the adapter plug. The keeper bolt, when installed, maintains the position of the pin and adapter plugs in the mounting member.

With the present invention, a given attachment can be coupled to a variety of boom configurations by merely substituting or repositioning the adapter plugs. The adapter plugs define the pin diameter, as well as the pin spacing. As a consequence, custom machining of boom attachments, such as hammers, compactors and tampers, is not required.

A common attachment can be fitted to a wide variety of booms by simply substituting adapter plugs of various configurations in order to provide the required pin spacing and pin diameters.

According to a feature of the invention, the flange portions of each adapter plug may be provided with a machining surface by which the transverse spacing between associated adapter plugs can be modified in order to accommodate the transverse dimension of a boom component that is positioned between the side plates and held in position by the pin carried by the adapter plugs. Alternately, thrust washers may be loosely positioned on the pin to accommodate changes in boom component width. In still an alternate embodiment, the thrust washers may be secured to the adapter plugs by suitable means, such as by welding.

In still another embodiment of the invention, fabricated adaptors are disclosed. In this alternate embodiment, adaptors of dissimilar configurations are employed. One of the adaptors includes a sleeve-like, annular member that includes a reduced diameter portion that is sized to be received in a circular recess portion formed in an associated side plate. A tab is fixed as by welding and extends radially from the reduced diameter portion and is engageable with a lug recess portion forming part of the adaptor receiving aperture. When the adaptor is installed, the lug prevents relative rotation a between the adaptor and the associated side plate.

The other adaptor configuration of this embodiment includes an elongate plate sized to be received in a similarly shaped aperture in an associated side plate. The plate includes machined abutment walls which abut an inside surface of an associated side plate. A throughbore for receiving a mounting shaft is defined by annular collar-like members which are fixed as by welding to opposite sides of the elongate plate. Once the elements are fixed to the plate a bore is drilled or machined through all three elements to define the throughbore. Both adaptors have aligned radial bores which are adapted to receive a locking element which extends through the bores and a crossbore formed in a mounting shaft.

Additional features of the invention will become apparent and a fuller understanding obtained by reading the following detailed description made in connection with the accompanying drawings.

BEST MODE FOR CARRYING OUT THE INVENTION

Figure 1:
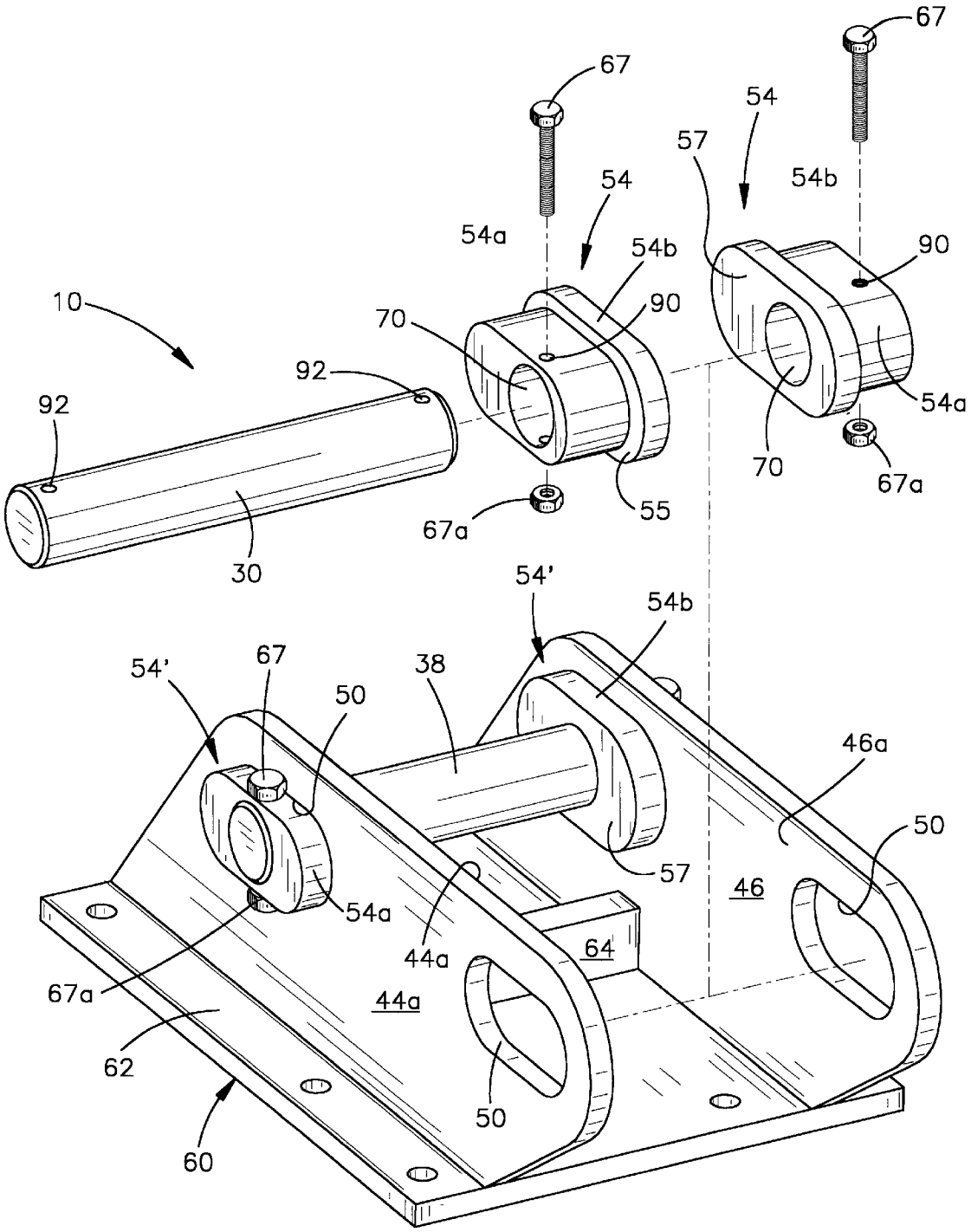
FIG. 1 is a perspective and partially exploded view of an implement mounting system constructed in accordance with the preferred embodiment of the invention.
Figure 2:
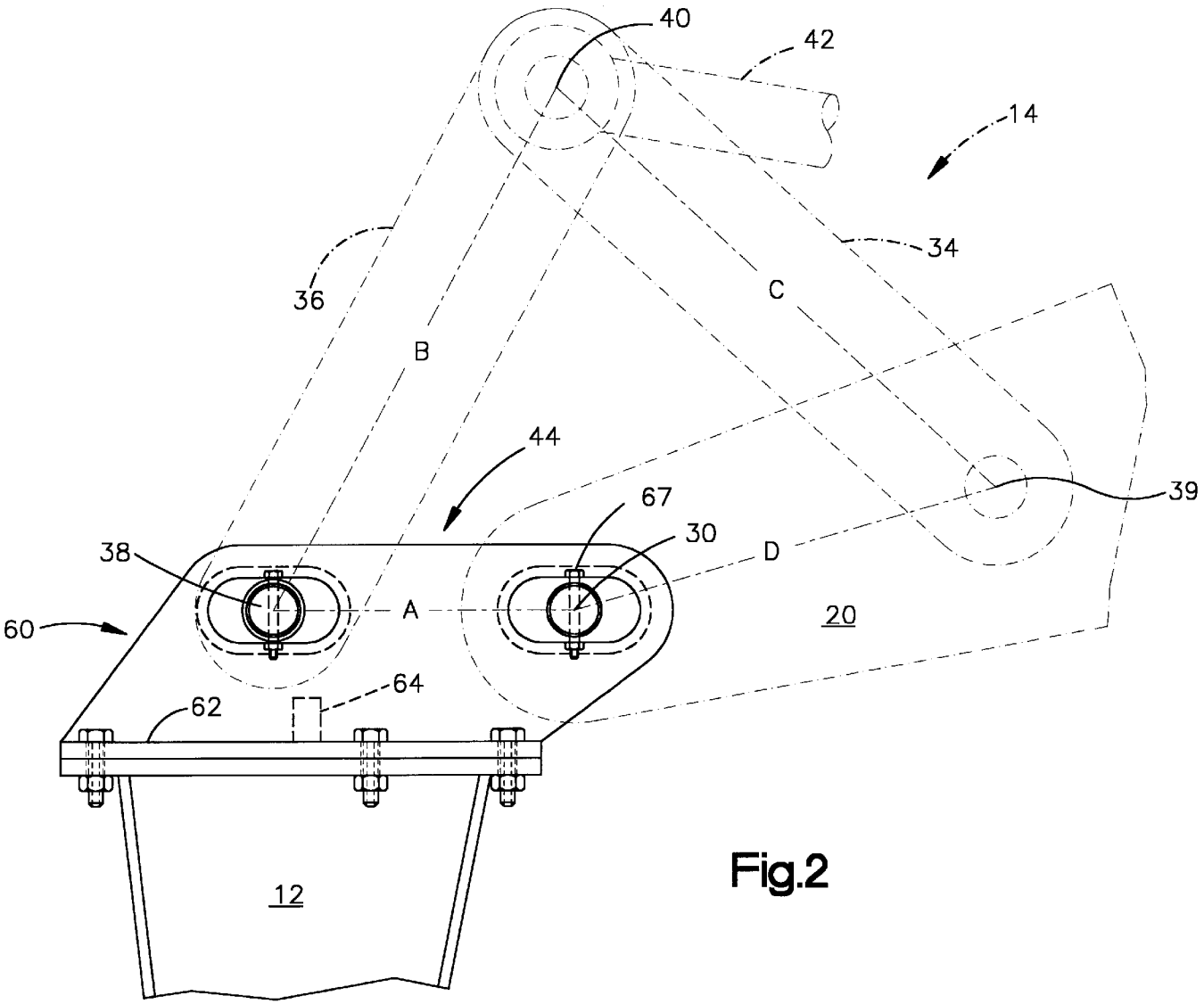
FIG. 2 is a side elevational view of the mount system of FIG. 1 shown as it would be used to attach a hammer assembly to a boom of an excavating machine.
Figure 3:
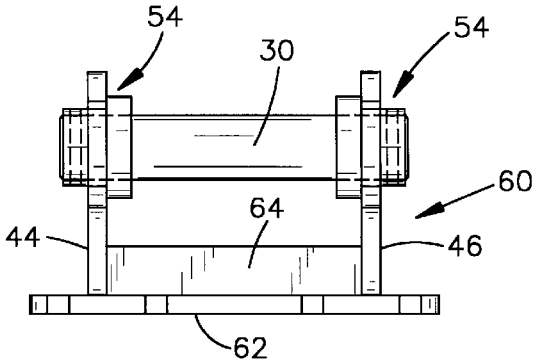
FIG. 3 is an end view of the mounting system.
Figure 4:
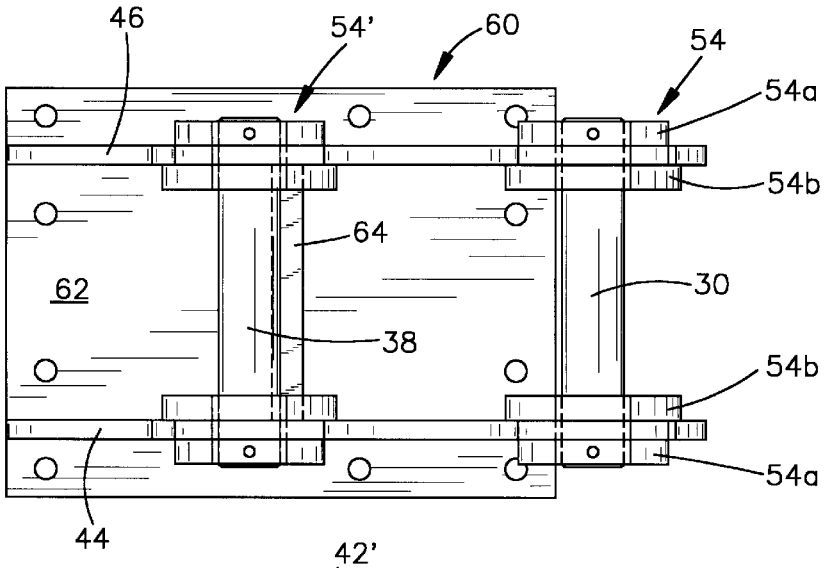
FIG. 4 is a top plan view of the implement mounting system.

FIG. 1 illustrates the overall construction of an implement mounting system 10 constructed in accordance with the preferred embodiment of the invention. Referring also to FIG. 2, the mounting system 10 provides a means for attaching an implement, such as a hammer 12, to boom and linkage assembly 14 of a construction vehicle, such as an excavator. The mounting system 10 enables a given attachment, such as the hammer 12, to be coupled to booms made by a variety of manufacturers and eliminates the need for manufacturing individual attachments with specific mounting configurations.

FIG. 2 illustrates how an attachment such as a hydraulic hammer 12 is operatively coupled to the end of the boom and linkage assembly 14 (shown in phantom). As is conventional, the boom assembly comprises a "stick" 20 which is pivotally connected to the vehicle and is raised and lowered by a suitable actuator, such as a fluid pressure operated actuator (not shown). A distal end of the boom stick 20 is pivotally connected to a pin member 30 (shown best in FIG. 1).

A pair of link arms 34, 36 extend from the boom stick 20 to another pin 38. A lower end of the link arm 34 is pivotally attached to the boom stick 20 at a pivot 39 whereas a lower end of the link arm 36 is pivotally attached to the pin 38. The links 34, 36 are pivotally connected to each other at a pivot 40. An actuator, such as fluid pressure operated cylinder 42, is carried by the boom stick 20 and is operatively connected to the pivot 40. It should be apparent that extension and retraction of the actuator 42 causes the mounting system 10 and attached hammer 12 to pivot about the pin 30. As is conventional, the connection between the boom 14 and the mount system 10 defines a four bar linkage with the bars designated by the letters A–D. With the disclosed construction and as is conventional, the boom stick 20 is raised and lowered to adjust the height of the attachment 12 with respect to ground level, whereas the actuator 42 is used to manipulate the links 34, 36 in order to adjust the orientation of the attachment 12.

The manufacturer of the boom 14 configures the linkage components and pivot locations to operate with particular pin diameters and particular pin spacings which usually form part of the attachment. As a result, attachments such as the hammer 12 were manufactured, in the past, with mounting locations intended to work with a boom made by a particular manufacturer.

The disclosed mounting system 10 allows a given attachment, such as the hammer 12 to be connected to a wide variety of booms and eliminates or reduces the need for custom machining of the attachment in order to accommodate the pin diameter and pin spacing required by the boom.

According to the invention, the mounting system includes a pair of spaced apart, parallel side plates 44, 46 which define at least one pair, but preferably two pairs of aligned adapter apertures 50. The apertures 50 are sized and arranged to receive a pair of adapter plugs 54 which together define the mounting location for at least one of the pins 30, 38. In the preferred embodiment, the plugs 54 and a pair of plugs 54' define the mounting locations for pins 30, 38, respectively. The side plates 44, 46 form part of a mounting member 60. In the embodiment illustrated in FIG. 1, the mounting member 60 is a weldment and also includes a lateral mounting plate 62 and a rigidizing transverse rib 64, which extends between inside surfaces 44*a*, 46*a* of the side plates 44, 46. The mounting plate 62 provides an attachment point for the hammer 12 and includes suitable mounting holes by which the hammer is bolted to the mount member 60.

In the preferred and illustrated embodiment, an aperture 50 and associated adapter plug 54 are sized and shaped to resist relative rotation. As seen in FIG. 1, the aperture 50 is non-circular and in the preferred embodiment is oblong or oval. The aperture 50 is adapted to receive a similarly shaped portion 54*a* of the adapter plug 54. It should be noted that the present invention contemplates other shapes for the adapter plug in order to provide the "nonrotational" feature. For example, the aperture and associated adapter plug portions may be shaped as a square, rectangle, ellipse, etc. Splined openings may also be used in order to provide the nonrotational engagement between the adapter 54 and associated side plate.

In the illustrated embodiment, each adapter plug 54 includes a flange portion 54*b* which defines an inner thrust surface 55 that abuts the inside surface i.e. surface 44*a* of the associated side plate 44. The flange portion 54*b* is larger in dimension than the portion 54*a*.

Each adapter plug defines an outer surface 57 which serves as a thrust surface for the boom component that is coupled or connected to the associated pin.

According to the invention, the adapter plugs 54, 54' are used to define a variety of boom mounting locations for a given mount member 60. The size of the bores 70 formed in an associated pair of adapter plugs 54 determines the pin diameter that will be accommodated. In addition, the location of the bores 70 in the adapter plugs 54, 54' determines the spacing between the pins 30, 38. By substituting appropriately machined adapter plugs in the mounting member 60, the mounting locations for the pins 30, 38 can be easily changed to accommodate a variety of boom geometries. In addition, in the preferred embodiment, the adapter plugs are symmetrical and can be rotated 180° and reinstalled. If the pin bore 70 is located off-center, a change in pin distance can be provided by simply reorienting the associated pair of adapter plugs.

With the disclosed invention, a multitude of plug adapters having a variety of pin bore diameters and pin bore locations can be manufactured, inventoried and then supplied as a form of "kit", which would be used to adapt a mounting member 60 to a given boom configuration.

According to a feature of the invention, the flange portion 54*b* of each adapter plug may be configured to provide a machining surface that is used to adjust the transverse spacing between a pair of plug adapters. As can be seen in FIG. 1, the thickness of the flange portion 54*b* of each adapter plug 54 determines the side-to-side spacing and, hence, the width of the boom components that will be accommodated. It should be noted here that a machinable surface on the plug member may be replaced by thrust washers, the thickness or number of which will determine the side-to-side spacing. The invention contemplates loosely fitting the thrust washers on the pins 30, 38 or alternately securing the washers to the associated adapter plugs as by welding.

Figure 5:
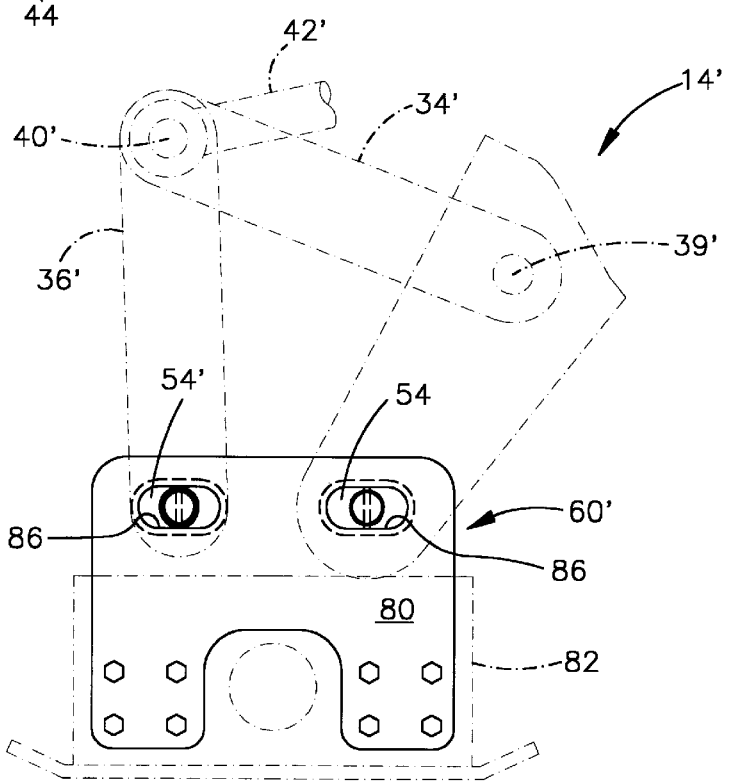
FIG. 5 is a side elevational view of another embodiment of the invention that is used to attach a compactor or tamper mechanism to a boom.

FIG. 5 illustrates the invention as used with a tamper or compactor mechanism. In this embodiment, a mount member 60' is attached to a boom 14' using the adapter plug/pin arrangement described above. In this embodiment, the mount member 60' includes a pair of yoke-shaped side plates 80 (only one is shown). A tamper or compactor mechanism 82 is suspended between and attached to the yoke plates 80. An upper section of each yoke plate defines at least one, but preferably two, oblong apertures 86 adapted to receive adapter plugs 54, 54' which define the size of the pins that will be accommodated, as well as pin spacing. Like the embodiment of FIGS. 1–4, the adapter plugs 54, 54' would be replaced with plugs having a different bore diameter or bore location, or both, to accommodate a change in boom geometry.

In the preferred embodiment, each anti-rotation portion 54*a* of an adapter plug 54 also includes a pair of aligned bores 90 which open into the pin bore 70. Each pin includes transverse bores 92 formed near its distal ends. The bore 92 on one end of the pin is alignable with the bores 90 of an adapter plug 54 when the pin is positioned within the adapter plug 54. The aligned bores 90, 92 are adapted to receive a keeper bolt 67 which secures each end of the pin to its associated adapter plug 54. A nut 67*a* fixes the position of the keeper bolt 67. When assembled in the mount member 60, the keeper bolts 67 secure the location of the adapter plugs and pin within the mount member 60. It should be apparent that when the keeper bolts 67 are installed on both ends of the pins 30,38, a relatively rigid assembly is established which maintains the pins and associated adapter plugs in their operative positions shown in FIGS. 2–5.

The mounting system of the present invention has been shown as it would be attached directly to a boom and its associated linkage. However, the invention is also usable with coupler mechanisms which are becoming very common today. In particular, some heavy equipment operators now utilize a "coupler" that is directly attached to the boom stick and associated linkage. The coupler, in turn, is designed to engage a pair of spaced apart pins forming part of the implement that is to be attached to the boom. These couplers require and only operate with implements having a predetermined pin size and pin spacing and, in general, will not reliably engage an implement unless its pin diameter and pin spacing are within certain defined limits.

The present invention also contemplates other forms of the mounting system. In the embodiment disclosed in FIG. 1, the mounting member 60 is bracket-like in configuration and acts as an intermediate connection between the boom assembly 14 and the attachment which, in FIG. 1, is a hammer. In the embodiment shown in FIG. 5, however, the mounting member is actually in the form of two side plates which may form an integral part of the compactor mechanism. These integral side plates are formed with the requisite apertures for receiving adapters 54, 54' which determine the pin size and pin spacing for the attachment. In short, the mounting member in which the adapter plugs 54, 54' are installed, does not need to be a separate component, but may form an integral part of the attachment.

The adapter plugs 54, 54' have been described as replaceable in the embodiments disclosed above. However, it should be apparent that once a predetermined adapter plug configuration has been selected, the adapter plugs 54, 54' can be permanently secured to their associated side plates as by welding. When welded, an extremely rigid assembly is provided.

The present invention enables an attachment to be easily provided with a precise pin spacing, as well as the required pin diameter. This is achieved without requiring extensive or custom machining of the attachment. Instead, suitable adapters 54 are machined to provide the required pin diameters and pin spacing; the adapters are then inserted into the associated apertures of a common mount member to establish the requisite boom geometry. It should be apparent that a given implement or attachment can be used with a variety of boom configurations or coupler configurations by substituting appropriate adapters in the mount member 60 to provide the requisite pin diameter and pin spacing.

The embodiment shown in FIGS. 1–5 illustrate the invention as it would be used with a hammer 12. It should be understood, however, that the present invention shown in FIGS. 1–5 and the alternate embodiment of the invention shown in FIGS. 6–9 (to be described) can be used in connection with a wide variety of implements or attachments, such as buckets, grapples, and tampers. The present invention should not be limited to any particular implement or attachment.

FIGS. 6–9 illustrate an alternate embodiment of the invention. In the alternate embodiment, the shapes of the adapter plugs are different from those shown in FIGS. 1–5. In addition, the adapter plugs are "fabricated" from individual components rather than being cast as a unitary element and then machined in order to provide the requisite shape. The plug adapters shown in FIGS. 6–9 are considered to be less expensive than those shown in FIGS. 1–5 in those applications where only a relatively small number of adapters will be manufactured. It should be understood by those skilled in the art that, when sufficient quantities of a given element are required, the use of cast parts followed by machining provides a less expensive method for providing the requisite adapters. In short, the disclosed fabricated parts (shown in FIGS. 6–9) enable the invention to be used cost effectively, even in those applications where only a small number of parts will be manufactured.

Figure 6:
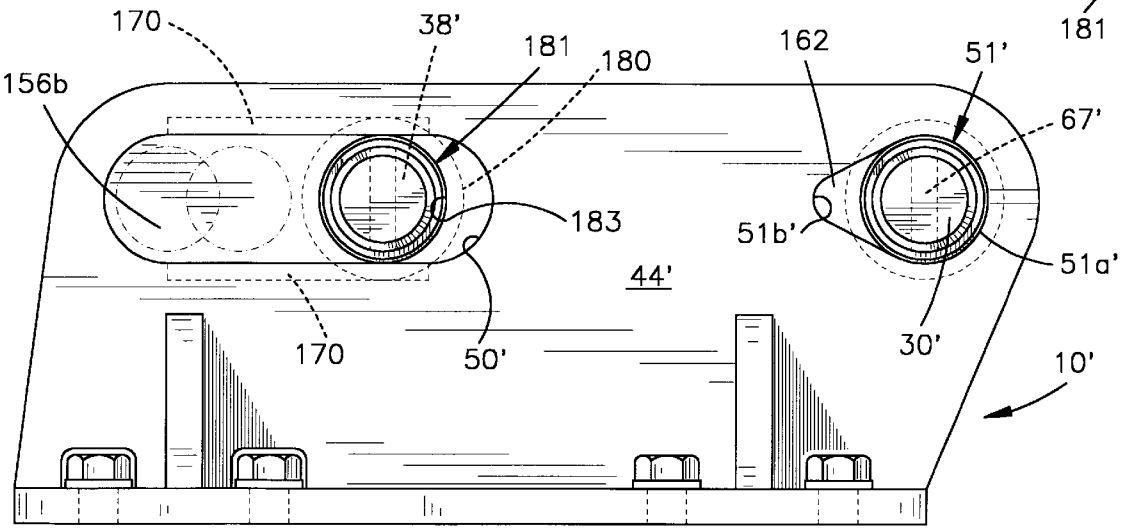
FIG. 6 is a side elevational view of an alternate embodiment of a mount system.

FIG. 6 shows a side view of an alternate implement mounting system 10'. According to this embodiment, the mounting system 10' includes a pair of spaced apart, parallel side plates 44', 46' (shown only in FIG. 9) which define two pairs of aligned apertures 50', 51'. In the illustrated embodiment the apertures 50', 51' are configured or shaped differently. One pair of apertures 50' is similar, if not identical in configuration to the apertures 50 forming part of the FIG. 1 embodiment. The other pair of apertures 51', however, are teardrop-shaped and are sized to receive a similarly configured plug member 154 (best shown in FIG. 8). The apertures 50' are adapted to receive fabricated adapter plugs 156, shown best in FIGS. 7.

Figure 8:
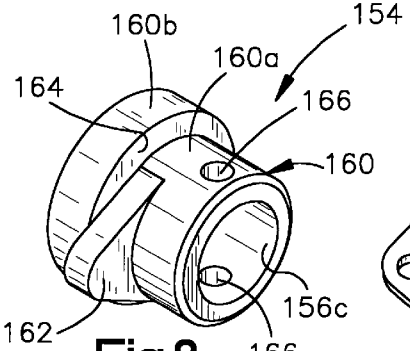
FIG. 8 is an enlarged perspective view of another adaptor forming part of the alternate embodiment; and, FIG. 9 is a perspective view of an implement mounting system constructed in accordance with the other preferred embodiment of the invention.
Figure 7:
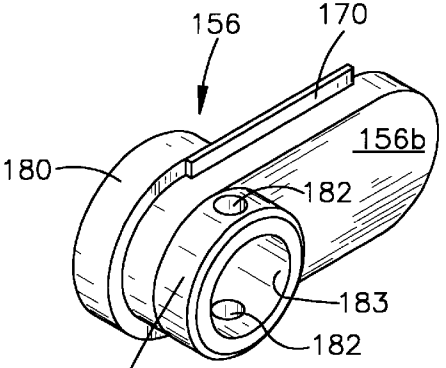
FIG. 7 is an enlarged perspective view of one of the mounting system adaptors forming part of the alternate embodiment shown in FIG. 6.

In the preferred embodiment, the plug adapter 154 shown in FIG. 8, is comprised of a annular, sleeve-like member 160 which may be machined in a turning operation. The sleeve-like member 160 includes a reduced diameter segment 160*a* which is sized to closely fit within a circular portion 51*a'* of an aperture 51'. A V-shaped tab 162 is attached to the side of the reduced diameter segment 160*a* of the adapter 154 to form a locking lug that is configured to be tightly received in an lug recess portion 51*b'* defined by the plug aperture 51'.

When the adapter 154 is inserted into the aperture, 51', the engagement of the locking lug 162 in the lug recess portion 51*b'* inhibits relative rotation between the adapter 154 and its respective side plate. The adapter 154 further includes a larger diameter flange-like segment 160*b* which includes a surface 164 that abuts an inside surface of its respective side plate when the adapter is positioned in the aperture 51'. The enlarge diameter portion 160*b* locates the adapter axially.

The reduced diameter segment 160*a* includes aligned, radial bores 166 which are sized to receive a locking element such as the element 67 shown in FIG. 1. As explained earlier in connection with FIG. 1, the mounting system pin 30 which also includes a radial bore is pinned to an adapter by the locking element 67 which extends through the aligned bores formed in the adapter and the crossbore 92 formed in the pin 30. A locking pin 67' is shown in phantom in FIG. 6. As in the FIG. 1 embodiment, once the shaft 30' (shown in FIG. 9) is pinned to both adapters 154, the axial position of the shaft 30' is fixed which also inhibits movement of the adapters out of their respective apertures 51'.

The adapters 156 (shown in FIGS. 7 and 9) include an elongate oval-shaped plate 156b sized to be received within an associated aperture 50'. The elongate plate 156*b* is machined to form upper and lower abutment walls 170 which extend along a linear portions of the plate 156*b*.

In a preferred embodiment, a pair of annular, collar-like elements 180, 181 are attached on opposite sides of the plate 156*b*. The elements 180, 181 are secured to the plate 156*b* as by welding. The elements 180, 181 are aligned such that a throughbore 183 can be machined by drilling through all three elements i.e., 180, 156*b*, 181. The throughbore 183 is sized to receive the shaft 38' (shown in FIGS. 6 and 9). The elements 180, 181 may also comprise solid disks which after attachment to the plate 156*b* are drilled or machined to define the bore 183.

The element 181 has a reduced diameter as compared to the element 180 and is preferably equal to or less than the vertical height of the aperture 50' as viewed in FIG. 6. The reduced diameter element 181 includes a pair of aligned radial directed bores 182 which are adapted to receive a locking element (such as element 67 shown in FIG. 1). As explained earlier, the locking element extends through the bores 182 and through a aligned crossbore formed in the mounting shaft 38'.

Alternately, if space permits, the throughbore 183 may be defined by a sleeve-like member (not shown) which may be similar or identical to the member 160. This sleeve-like member would extend through a hole defined in the plate 156*b* and be fixed therethrough as by welding. This alternate embodiment however would require a plate 156*b* that has a vertical dimension greater than the one shown in FIGS. 6 and 7.

Figure 9:
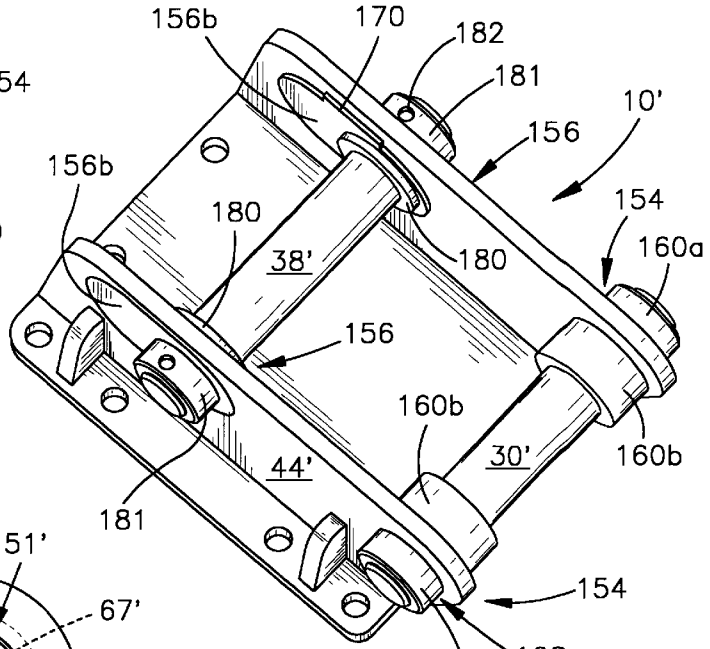

When the adapter plugs 156 are placed in position and locked to the cross shaft 38' by suitable locking elements, movement of the shaft and adapter plugs out of the positions shown in FIG. 9, is substantially inhibited. The locking elements prevent relative movement of the shaft 38' with respect to the adapters 156, whereas the abutment walls 170 prevent outward movement of the adapter plugs 156 with respect to the side plates 44', 46'.

To further rigidize the positioning of the adapter plugs 154, 156, welding may be employed to physically weld the adapter plugs to the side plates.

As explained in connection with the FIG. 1 embodiment, the size of the shaft receiving holes in the adapter plugs can be adjusted to accommodate a wide variety of shaft diameters. In addition, the elements 180, 181 can be positioned anywhere along the plate 156*b* to define a throughbore 183 that is positioned to accommodate specific shaft spacings. Examples of alternate positions for the throughbore 183 (as defined by the elements 180, 181) are shown in phantom.

The tear-drop shaped adaptor 154 is shown with a centrally positioned shaft receiving bore 156*c*. The bore 156*c* may also be offset to accommodate a variation in spacing of the mounting shafts.

Finally, although the plug adapter embodiments shown in FIGS. 6–9 are described as being fabricated from individual elements, it should be understood that these plug adapters may also be formed from a machined casting.

Although the invention has been described with a certain degree of particularity, it should be understood that those skilled in the art can make various changes to it without departing from the spirit or scope as hereinafter claimed.

I claim:

1. A mounting system for mounting an implement to a boom, comprising:

a) a pair of spaced apart, side plates;

b) each side plate including at least one aperture, said aperture of one side plate being located in alignment with an aperture on said other side plate;

c) adapter plugs sized to be received in said apertures and including structure for resisting relative rotation between said adapter plug and its associated aperture;

d) each adapter plug including a transverse bore which is sized to receive an associated portion of a first pin member;

e) each side plate including structure for receiving at least a portion of a second pin member, said second pin member being spaced from said first pin member;

f) said bore in said adapter plug being located such that said location at least partially defines the distance between said first pin member and said second pin member; and g) each adapter plug defining a flange portion including a surface that abuttably engages a side surface of its associated side plate;

h) said first and second pin members forming part of respective first and second pivot connections by which said implement is adapted to be operatively attached to said boom.

2. The apparatus of claim 1, wherein said side surface of its associated side plate is located on the inside of said side plate.

3. The apparatus of claim 1, wherein said flange portion defines a thrust surface for a boom member coupled to said first pin member.

4. The apparatus of claim 3, wherein said thrust surface is machinable to adjust a lateral spacing between the adapter plugs received in said aligned apertures of said pair of side plates.

5. The apparatus of claim 4, wherein another portion of said adapter plug includes a keeper bolt bore alignable with a bore in said associated portion of said first pin member, which is adapted to receive a keeper bolt for maintaining a fixed relationship between said adapter plug and said first pin member.

6. The apparatus of claim 1, wherein said side plates form part of a mounting bracket.

7. The apparatus of claim 1 wherein said apertures are non-circular and said structure for resisting relative rotation between the adapter plug and its associated aperture comprises a non-circular portion of the adapter plug which is sized to be received in said non-circular aperture.

8. The apparatus of claim 1 wherein said aperture in said side plate is non-circular and said structure resisting relative rotation between said adapter plug and its associated aperture includes a lug forming part of said adapter plug which is sized to be received in a lug receiving recess defined by said non-circular aperture.

9. A mounting system for mounting an implement to a boom, comprising:

a) a pair of spaced apart, side plates;

b) each side plate including at least one aperture, said aperture of one side plate being located in alignment with an aperture on said other side plate;

c) adapter plugs sized to be received in associated one of said apertures and including structure for resisting relative rotation between said adapter plug and its associated aperture;

d) each of said apertures defining a lug receiving recess;

e) each adapter plug being sleeve-like in configuration including a first diameter segment and a reduced diameter segment, said reduced diameter segment configured to pass through a circular portion of said aperture;

f) a lug extending laterally from said reduced diameter segment and adapted to be received in said lug receiving recess of an associated aperture;

g) said first diameter segment of each adapter plug defining a radial, abutment surface abutably engageable with a side surface of its associated side plate h) said adapter plugs at least partially defining a pivot connection by which said implement is adapted to be operatively attached to said boom.

10. The apparatus of claim 9 wherein said side surface of its associated side plate is located on the inside of said side plate.

11. A mounting system for mounting an implement to a boom, comprising:

a) a pair of spaced apart, side plates;

b) each side plate including at least one elongate aperture, said elongate aperture of one side plate being located in alignment with an elongate aperture on said other side plate;

c) adapter plugs sized to be received in associated ones of said apertures and including structure for resisting relative rotation between said adapter plug and its associated aperture;

d) each adapter plug including an elongate plate member sized to be received in its associated elongate aperture whereby relative rotation is resisted, said plate member defining at least one abutment wall for abutably engaging a side surface defined by its associated side plate; and, e) first and second elements secured to opposite side surfaces of associated ones of said plate members and located in machineable alignment, said first and second elements and said associated plate member defining a throughbore for receiving a mounting pin member;

f) said mounting pin member forming part of a pivot connection by which said implement is adapted to be opratively attached to said boom.

12. The apparatus of claim 11 wherein said first and second elements comprise annular, collar-like elements positioned substantially in axial alignment on an associated plate member.

13. The apparatus of claim 11 wherein said first element has a first diameter and said second element has reduced diameter as compared to said first element and said elements are welded to opposite sides of said plate member.

14. An implement and a mounting system for mounting an implement to a boom, comprising:

a) a pair of spaced apart, side plates forming part of said implement;

b) each side plate including at least one aperture, said aperture of one side plate being located in alignment with an aperture on said other side plate;

c) adapter plugs sized to be received in said apertures and including structure for resisting relative rotation between said adapter plug and its associated aperture;

d) each adapter plug including a transverse bore which is sized to receive an associated portion of a first pin member;

e) each side plate including structure for receiving at least a portion of a second pin member, said second pin member being spaced from said first pin member;

f) said bore in said adapter plug being located such that said location at least partially defines the distance between said first pin member and said second pin member; and e) each adapter plug defining a flange portion including a surface that abuttably engages a side surface of its associated side plate f) said first and second pin members forming part of respective first and second pivot connections by which said implement is adapted to be operatively attached to said boom.

* * * * *